US005220419A

United States Patent [19]

Sklar et al.

[11] Patent Number: 5,220,419

[45] Date of Patent: Jun. 15, 1993

[54] AUTOMATIC RF LEVELING IN PASSENGER AIRCRAFT VIDEO DISTRIBUTION SYSTEM

[75] Inventors: Richard E. Sklar, Huntington Beach; Irving Rabowsky, Woodland Hills, both of Calif.

[73] Assignee: Hughes Aircraft Company, Los Angeles, Calif.

[21] Appl. No.: 681,850

[22] Filed: Apr. 8, 1991

[51] Int. Cl.[5] ..... H04H 1/02

[52] U.S. Cl. ..... 358/86; 455/6.3; 455/14; 455/234.2; 455/253.2

[58] Field of Search ..... 455/3.1, 6.1, 6.2, 6.3, 455/14, 66, 67.1, 67.3, 234.1, 234.2, 240.1, 249.1, 253.2; 358/86; 375/98

[56] References Cited

U.S. PATENT DOCUMENTS

| | | | |
|---|---|---|---|
| 2,857,482 | 10/1958 | Putzrath et al. | 455/3.1 |
| 3,704,419 | 11/1972 | Rheinfelder | 455/6.1 |
| 3,737,774 | 6/1973 | Verhagen | 455/234.1 |
| 4,439,784 | 3/1984 | Furukawa et al. | 455/6.3 |
| 4,584,603 | 4/1986 | Harrison | 455/6.3 |
| 4,866,515 | 9/1989 | Tagawa et al. | 455/6.3 |

*Primary Examiner*—Reinhard J. Eisenzopf
*Assistant Examiner*—Andrew Faile
*Attorney, Agent, or Firm*—Terje Gudmestad; Wanda K. Denson-Low

[57] ABSTRACT

A passenger aircraft video distribution system distributes modulated RF signals provided from a central signal source to be used at each passenger seat. The RF signals are distributed by means of various RF components, including amplifiers (90, 14*a*, 164, 24*a*, 24*b*, 34*a*), taps (180, 210) and splitters (108, 182, 214). In order to ensure proper RF levels for best tuner operation, each of a number of stations in the distribution system is provided with a variable gain amplifier (90, 14*a*, 164, 24*a*, 24*b*, 34*a*) controllable by a microprocessor (92, 50*a*, 220, 52*a*, 56*a*, 216). A separate service line (222, 224, 226, 228, 230, 232, 234) enables a central microprocessor to monitor RF levels at different stations to automatically provide, via the same service line, appropriate gain control signals to obtain proper RF levels. The monitored RF levels are also employed for diagnostic purposes.

9 Claims, 6 Drawing Sheets

4/6
208-1
208-2
206
210
TAP
56a
MICRO PROCESSOR
30a
230
214
SPLITTER
36a
36b
TUNER 1
TUNER 2
DATA DEC
MP I/O
MP I/O
230
232
234
TAP
207
MICRO PROCESSOR
SPLITTER
TUNER 1
TUNER 2
DATA DEC
MP I/O
MP I/O
194-1
194-2
188
TAP
MICRO PROCESSOR
SPLITTER
TUNER 1
TUNER 2
DATA DEC
MP I/O
MP I/O

AUTOMATIC RF LEVELING IN PASSENGER AIRCRAFT VIDEO DISTRIBUTION SYSTEM

BACKGROUND OF THE INVENTION

1. Field of the Invention

The present invention relates to passenger aircraft video distribution systems and more particularly concerns control of RF signal levels of such a system.

2. Description of Related Art

Each passenger of a passenger aircraft may be provided with an individually controllable electronics box unit to enable personal selection from among a group of different audio signals and a group of different video signals. The audio signals, and also the video signals, together with their own audio, are transmitted to each of the passenger seats from one or more central audio and/or video sources. The various entertainment signals are modulated upon individual ones of a plurality of RF carriers of different frequencies and transmitted to the individual passenger seats via a series of transmission stations which amplify the several signals, split the signals into different groups for transmission to different areas of the aircraft and tap signals off for use at the passenger seat. It is essential to ensure that optimum RF input levels of the video signal are provided to the video tuners at the individual passenger seat units. If the RF level at any seat unit is too low the signal is weak, and video may be poor, exhibiting "snow". At least partly because each video signal is modulated upon its own RF carrier, if the RF signal levels are too high, excessive inter-modulation products may be generated which would be visible to the passengers using the video tuners.

One possible approach to handling this problem of ensuring proper RF power levels throughout the system is to provide an automatic gain control function for each of the amplifiers, with parameters determined by system level requirements. However, this is not practical in the environment of a passenger aircraft because the aircraft configuration is frequently changed. Thus airlines often add or remove seats from one row or column, add additional channel capability by including additional sources of video channels or audio channels, or otherwise reconfigure the entertainment distribution system. With such reconfiguration, video signals encounter additional cable loss or additional gain, thereby changing power levels in the system. Changes in power level may be of such a magnitude as to be beyond the range of the automatic gain control unit. For example, if additional loss is added to the system by lengthening of cables, automatic gain control circuits of downstream amplifiers may not have enough range to compensate for lowered RF signal levels caused by the added cable loss. Therefore a fixed range automatic gain control amplifier would not be adequate.

Another situation in which fixed automatic gain control is inadequate is the occurrence of a failure. For example, if one amplifier in the system degrades in such a way that its output cannot be increased to the required level, or if some other element fails so as to greatly increase the power loss in the system, it may be necessary to compensate by increasing levels upstream of the failed element. The various electronic stations, which contain the gain control amplifiers, are ordinarily not easily accessible, nor is there often an available technician who is sufficiently knowledgeable for adjustment and readjustment of RF levels and gains throughout the system. Further it is also desirable to report the nature and location of any failure or degradation of operation to a central location for diagnostic purposes. Present systems provide for no such diagnosis.

Accordingly, it is an object of the present invention to provide a multiple signal distribution system that avoids or minimizes above-mentioned problems.

SUMMARY OF THE INVENTION

In carrying out principles of the present invention in accordance with a preferred embodiment thereof a multichannel signal distribution system employs a series of variable gain amplifiers, at different stations, which are capable of being adjusted to control signal levels at the amplifier outputs. Amplifier outputs are monitored and supplied to a central processor which evaluates the monitored signal levels according to pre-defined criteria and commands adjustment of one or more of the variable gain amplifiers in order to bring the amplifier signal output levels to or within a desired range of levels.

DESCRIPTION OF THE PREFERRED EMBODIMENT

Figure 1:
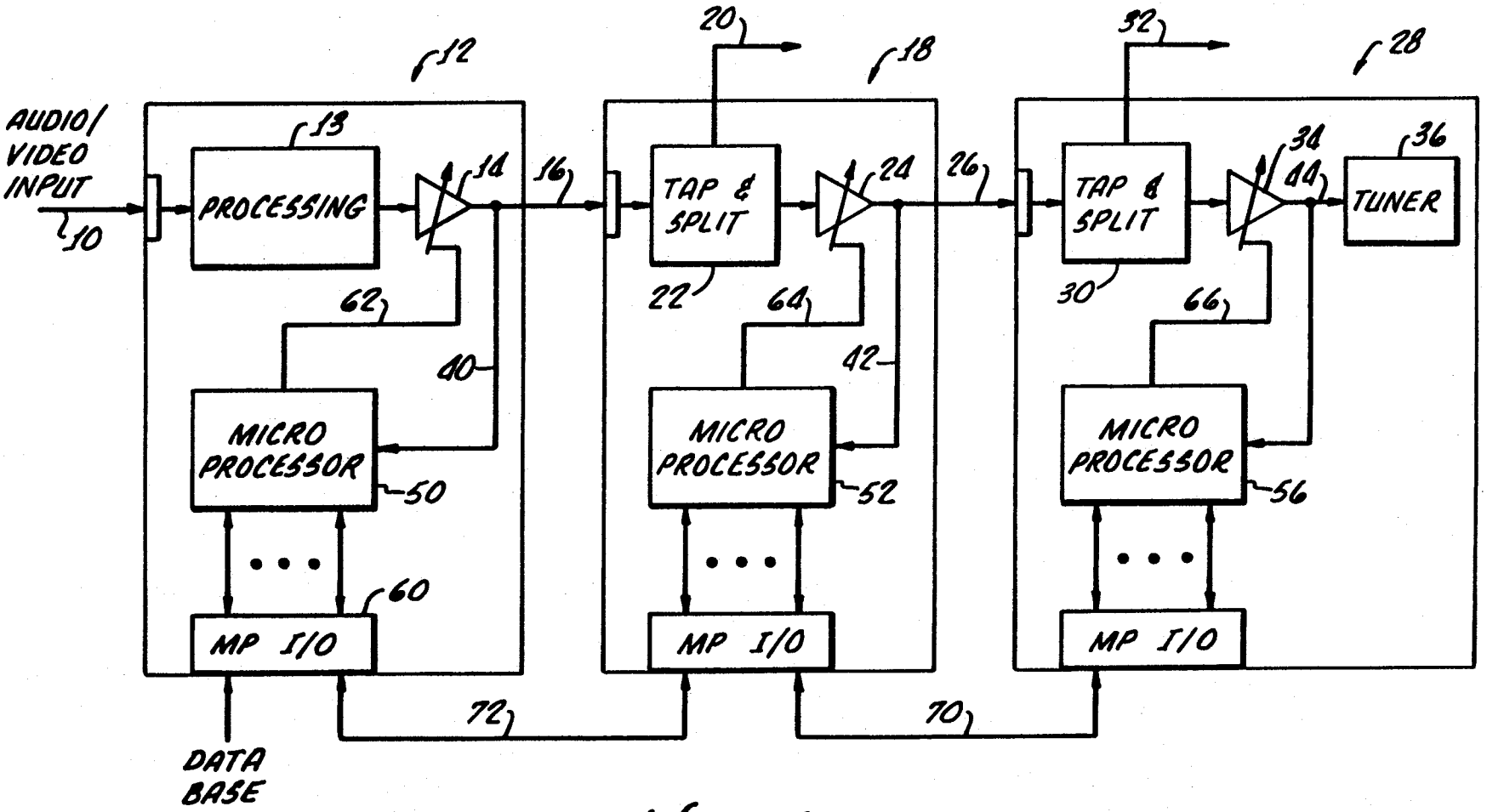
FIG. 1 is a greatly simplified block diagram showing several processing stations in a signal distribution system and the control of variable gain amplifiers thereof.

In the very much simplified system illustrated in FIG. 1 a plurality of audio and video inputs on a line 10 from a plurality of input sources (not shown) are fed to a first station 12 which is termed a passenger entertainment service controller station or PESC wherein the signals are processed in processing circuitry 13 and fed through a variable gain amplifier 14. The amplifier has an output on a cable 16 which is fed as the input to the next downstream station 18, which may be, for example, an area distribution box station (ADB). In the area distribution box the signal is transmitted via a line 20 to additional area distribution boxes (ADB's). In addition, the signals are tapped in a tapping and splitting circuit 22 to be amplified in a variable gain amplifier 24. The output of amplifier 24, which comprises the signals fed to one branch of this entertainment system, are transmitted via a cable 26 by means of one or more intermediate downstream stations (not shown in FIG. 1) to a video seat electronics box station (VSEB) 28 which is located at the passenger seat. Electronics box 28 includes a tapping and splitting circuit 30 that receives the transmitted signal on cable 26, splits the signal for transmission to further seat boxes on a cable 32, and taps the signal to provide an input to a variable gain amplifier 34, which feeds the individual signal to an individual passenger tuner 36 at the passenger seat. The variable gain amplifiers described herein each comprises a variable attenuator that feeds into an amplifier of predetermined gain. Thus the net gain of each variable amplifier is adjusted by adjusting the amount of attenuation provided by the variable attenuator.

As previously mentioned, it is of importance to be able to readily control and adjust RF signal levels at various ones of the several stations of the system, and, in particular, to control the level of the RF signals going into the passenger seat tuner 36. These functions are achieved by providing monitoring points on lines 40, 42 and 44 at the output of each of the amplifiers so that at each of these monitoring points a microprocessor monitoring signal may be obtained to provide a measurement of the level of the RF signal at the output of the respective amplifier. This monitoring signal may be manually monitored in a suitable central display, and appropriate gain controlling signals computed and fed back to the individual variable gain amplifier gain control inputs of the amplifier so as to bring the several RF signal levels up to an appropriate level or value. Preferably the monitoring and controlling is done automatically by means of processors, such as microprocessors 50, 52 and 56, provided at each of the stations 12, 18 and 28, respectively. Microprocessor 50 in station 12 may be considered to be a master processor and receives, via the microprocessor input/output circuit 60, a data base which is loaded into the system upon its initialization. This data base, which is loaded into each of the processors at the several stations, contains among other things information defining cable and seat column lengths, e.g. number of video seat electronics boxes fed by a single coax cable, the number and type of the several stations, such as stations 12, 18 and 28, including all other items which affect the distribution of the Video. The data base contains the number of VSCV's, PESC's, ADB's, VSEB's in each seat column, length of cable between each unit, desired RF levels at each amplifier output and the acceptable range, in addition to other items not related to the video distribution system. The information is sufficient to enable the microprocessor to compute the selected RF levels or may actually contain pre-computed RF levels for the variable gain amplifier at each station. Such data base is fed or keyed into the microprocessor 50 through its input/output circuit 60. The several stations communicate with one another by a separate communication or service path which is independent of the RF coaxial cable forming the RF signal path lines 16 and 26.

Initially the system provides substantially conventional automatic gain control of the amplifiers. The microprocessor at each station monitors the RF signal level at the output of its amplifier, such as, for example, by monitoring the signal level on line 40 at the output of amplifier 14. For this station 12 the microprocessor provides a gain control signal on a line 62 to control the gain of amplifier 14 so as to hold the RF signal level at the amplifier output to or within a selected range of levels. Similarly microprocessor 52, at station 18, monitors the level of the RF signal at the output of amplifier 24 and provides a gain control signal on a line 64 to the gain control input of amplifier 24. Microprocessor 56 at station 28 monitors the output of amplifier 34 on line 44 and via a line 66 controls gain of variable gain amplifier 34. The gain control functions, both monitoring and sending of gain control signals between and among the several stations, are accomplished by a separate service and data path, independent of the signal transmission cables 16 and 26, and generally indicated as having a first service path leg 70 between stations 18 and 28 and a second service path leg 72 between stations 18 and 12.

The system is established so that the microprocessor at each station monitors the level of the output of the amplifier at the same station and controls such an amplifier as long as the amplifier has a sufficient range of gain adjustment so that the level of the amplifier output can be maintained within a selected range of levels. In this aspect of its operation, each of the variable gain amplifiers acts very much like a conventional automatic gain control amplifier. However, the monitored RF level is not only provided to the microprocessor at the individual station but is also fed back to the master microprocessor 50 at station 12 and upstream station microprocessor 52. For example, if the RF signal level at the output of amplifier 34 at the video seat electronic box station 28 is not within the allowable range of levels, the station 28 microprocessor 56 will adjust the gain of amplifier 34 in a manner that attempts to bring the RF signal level to or toward the predetermined range of RF signal levels at monitoring point 44. If the adjustment range of amplifier 34 is not sufficient to handle the degraded RF signal level, the monitoring signal at monitoring point 44 still shows a level that is out of range, and the local microprocessor 56 sends signals back on service line 70, which are received by microprocessor 52. Thus the latter is provided with information that shows both the presence of an out of range RF signal level at the downstream monitoring point 44 and the fact that the limit of the adjustment range of amplifier 34 has been reached. With this information microprocessor 52 is programmed to control its own amplifier 24 so as to adjust the RF signal level output of this amplifier, within the allowable range of levels for amplifier 24, in a manner to compensate for the out of range level of the RF signal at the output of amplifier 34. If this adjustment is not sufficient, namely the adjustment of amplifier 24, so that the combined adjustment of both amplifiers 24 and 34 still leaves the system with an out of range RF level at monitoring point 44, this information is communicated to the master microprocessor 50 via service line 72, which then adjusts the gain of its amplifier 14 so as to bring the RF level at the output of amplifier 34 to the desired range. Alternatively, the system may be programmed so that the master microprocessor 50 will command adjustment of gains of all three amplifiers, amplifier 34, amplifier 24 and amplifier 14, if further gain adjustment of this amplifier is possible, so that no one amplifier need be adjusted to its limit. Adjustment of all three amplifiers collectively results in the RF level within the selected range of levels at the output of amplifier 34. It will be understood, of course, that even though an incorrect RF signal level at the output of amplifier 34 may require a relatively large gain adjustment of amplifier 34 to bring the level to and within the selected range, only a much smaller gain adjustment of the upstream amplifier at the next station, amplifier 24 at station 18, is required to obtain the same amount of change in RF level at the output of amplifier 34. This is so because any change in the RF level at the output of upstream amplifier 24 is amplified by the downstream amplifier 34. Similarly an even smaller amount of change is required of the gain of amplifier 14 of station 12 in order to effect a given change in RF level at the output of amplifier 34. Thus, using amplifiers with readily available ranges of gain adjustment, a large amount of gain variation is made available at amplifier 34, which provides the tuner input RF level that is responsible for the clarity on the viewer's screen.

In the case of a failure of one or more the downstream components, such as any of the components at stations 18 or 28, this information is communicated to the master controller 50 at station 12 so that its microprocessor may then send appropriate instructions via the service lines 72,70 to the appropriate stations to adjust the variable gain amplifiers and thus the RF power levels to critical points of the system in an attempt to compensate for the sensed failure condition. Furthermore, provision is made to notify airline maintenance personnel of the failure condition so that appropriate action to permanently correct the condition may be carried out. As noted previously, an independent service communication path, namely path 70, 72, is employed to distribute to all of the data base input, the monitored RF levels and the commanded gain adjustment comments. Because of this use of separate service line, the RF signal level control is independent of the functioning of the video distribution system itself. In other words, problems that occur in the video distribution system, including coaxial cable lines 16 and 26, have no effect on the service paths 70 and 72 so that proper monitoring and adjustment may be carried out independently of operation of the video communication path.

Illustrated in FIGS. *2a*, *2b*, *2c* and *2d*, collectively, is a block diagram of an exemplary passenger entertainment system embodying principles of the present invention. As illustrated in FIG. *2a*, a number, such as 8 for example, of analog video signals 71,72 are provided from a video source (not shown) as inputs to a first station 80 which may be termed a "video system control unit" or VSCU. The analog video inputs are each individually modulated in a separate one of a group of modulators generally indicated at 82, upon each of a number of different frequency RF carriers to provide at the output of modulator 82 a number, such as 8 for example, of different frequency RF carriers having modulated thereon, respectively, the analog video signals of 8 different video channels. For a larger system there may be an additional video system control unit station identical to station 80, providing an output on a line 84. Such output of the additional VSCU comprises a group of RF carriers of different frequencies (each different than the RF carriers of station 80), and each having modulated thereon a unique channel of analog video information. The 8 modulated RF carriers on the 8 output lines of modulator 82 and the group of modulated RF carriers on input line 84, if there be such an input, are combined in a circuit 86 that provides a single output including all of the modulated different frequency RF carriers. This modulated RF signal is fed to a variable gain amplifier 90, having its gain adjusted from the output of microprocessor 92, which communicates with microprocessor input/output logic 94.

A group of audio inputs 171,172, which may be for example 16 in number, are provided from an audio source (not shown), such as a CD, tape player, or the audio corresponding to the video sources 71,72, for example, and fed to an audio processing circuit 96, which samples and digitizes each of the audio analog signals and multiplexes all of the digitized audio samples to provide on a line 100 a serial bit stream comprising digital samples of each of the audio inputs in sequence. A more detailed description of the digitization of the audio inputs may be found in a co-pending application of Kenneth A. Brady, Jr. and Richard E. Sklar for Daisy Chain Multiplexer, Ser. No. 630,713 Filed Dec. 20, 1990, assigned to the assignee of the present application. The disclosure of this co-pending application is incorporated by this reference, as though fully set forth herein. The digital bit stream from audio processing circuit 96 is modulated in a modulator 102 and fed as a first input to a combiner 104, having as a second input the video modulated RF carriers at the output of amplifier 90. The audio signals are modulated in modulator 102 upon a carrier that is sufficiently high, having a frequency above the frequencies of the video modulated RF carriers, so that amplifiers and other signal transmission components of reasonably available band width may be employed. Thus, for example, several video modulated RF carriers may occupy a frequency band between about 50 and 300 megahertz, whereas the RF carrier upon which is modulated the digitized audio in modulator 102 may have a frequency in the order of about 360 megahertz. The several video and audio modulated RF carriers appear combined in line 106 and are fed to a splitter 108, which provides coaxial output cables 110 and 112 to a pair of tapping units for use of the video signals in other non-personal operations, such as the common aircraft cabin overhead projection system, for example.

The individual passenger entertainment signal is provided from the output of splitter 108 on a coaxial cable 114 to the input of a passenger entertainment service controller station 12a, which corresponds to station 12 of the much simplified block diagram of FIG. 1. The modulated RF signal on cable 114 is fed to a filter 120 in station 12a, which separates the relatively lower frequency or video carriers from the higher frequency audio modulated carrier. The audio appears on line 124, and the video on line 122 from filter 120. The audio modulated carrier is demodulated in a demodulator 130 to provide demodulated digitized audio samples that are fed to audio processing circuitry 132 which may also receive local audio analog inputs on input lines generally indicated at 134, 136. The local audio analog inputs are digitized and combined in a single serial bit stream with the digitized audio samples from demodulator 130 and fed on a line 138 to a modulator 140 which modulates this bit stream upon an RF audio carrier having the relatively higher 360 megahertz frequency previously described.

Modulated audio is fed as a first input to a combiner 142 which has as its second input the output of a variable gain amplifier 14a (corresponding to amplifier 14 of FIG. 1) which in turn receives the signals on line 122, comprising the video modulated RF carriers. The modulated RF carriers from the output of combiner 142 are fed via a coaxial cable 146 to a second passenger entertainment service controller 150, which may be identical to the passenger entertainment service controller 12a.

The second controller 150 is employed to enable use of an additional group of audio inputs indicated as being provided on lines 152, 154 to an audio processing circuit 156. The latter receives the output of a demodulator 158 at the input of which is received the high frequency audio modulated RF carrier from a high/low filter 160. The latter receives the video and audio modulated carriers on coaxial cable 146 and provides the low frequency video modulated carriers on a video line 162, and a higher frequency audio modulated carrier on a second output line 163. The video modulated carriers are fed to the input of vertical gain amplifier 164, which provides one input to a combiner 166. The other input to combiner 166 is provided from a modulator 168 receiving the digitized audio samples in the form of a serial bit stream on a line 170 and including in sequence the digital audio samples from audio inputs on lines 171 and 173 of station 80, audio inputs on lines 134 and 136 from station 12a, and the local audio inputs on lines 152, 154 of station 150. The coaxial cable output 170 of combiner 166, feeds to a first one of a group of four area distribution boxes (ADB's) 172, 174, 176, and 178, and, more specifically, to a variable gain amplifier 24a of area distribution box 172. The output of variable gain amplifier 24a is fed through a coupler 180 and thence in series to area distribution boxes 174, 176 and 178, each of which is identical to area distribution box 172. The audio and video modulated RF carriers are tapped from coupler 180 into a variable gain amplifier 24b, which in turn feeds to a splitter 182. Amplifiers 24a and 24b collectively correspond to amplifier 24 of the simplified block diagram of FIG. 1.

Figure 2A:
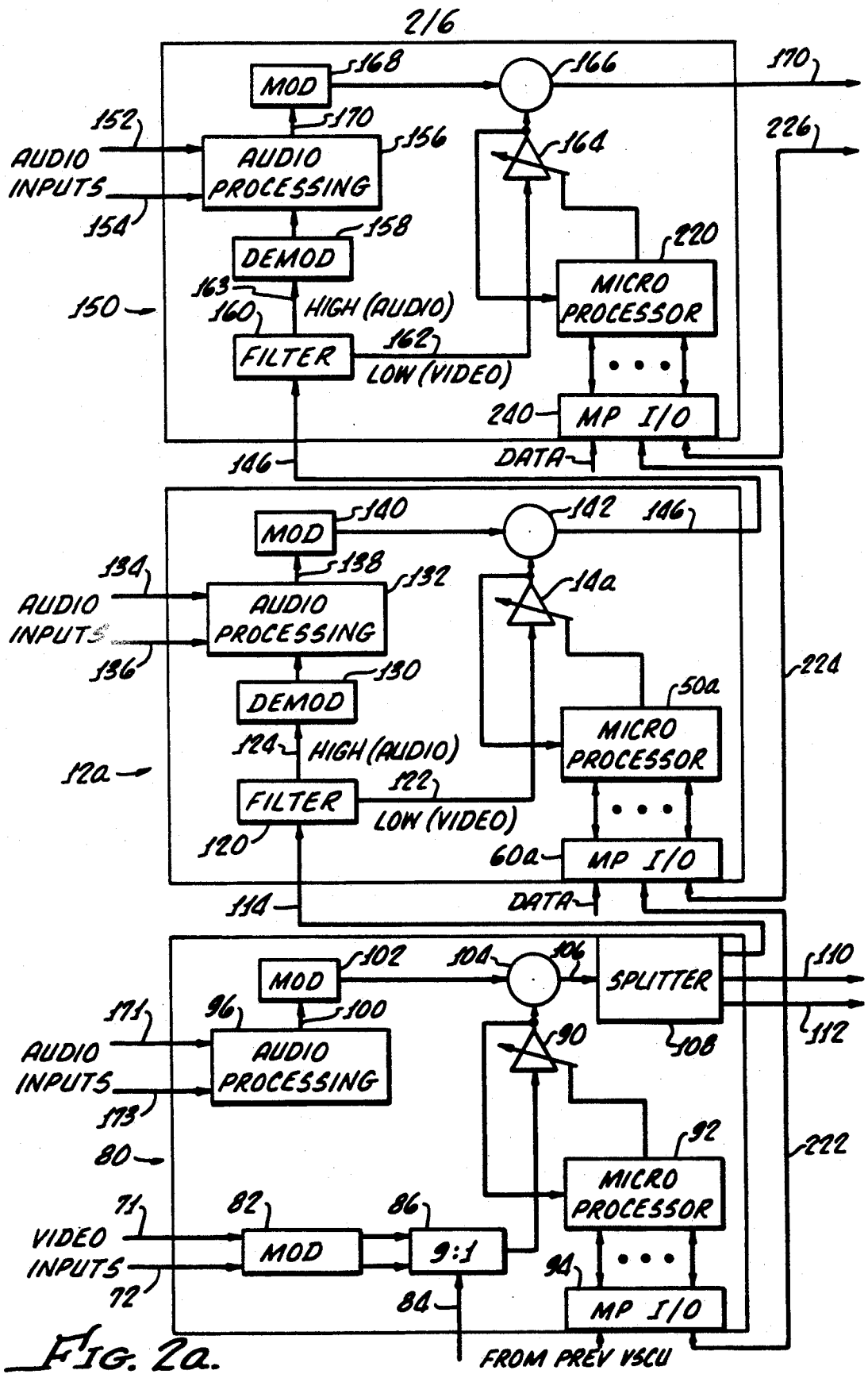
FIGS. 2*a*, 2*b*, 2*c* and 2*d* collectively comprise a more detailed block diagram of an exemplary passenger aircraft video distribution system embodying principles of the present invention.
Figure 2B:
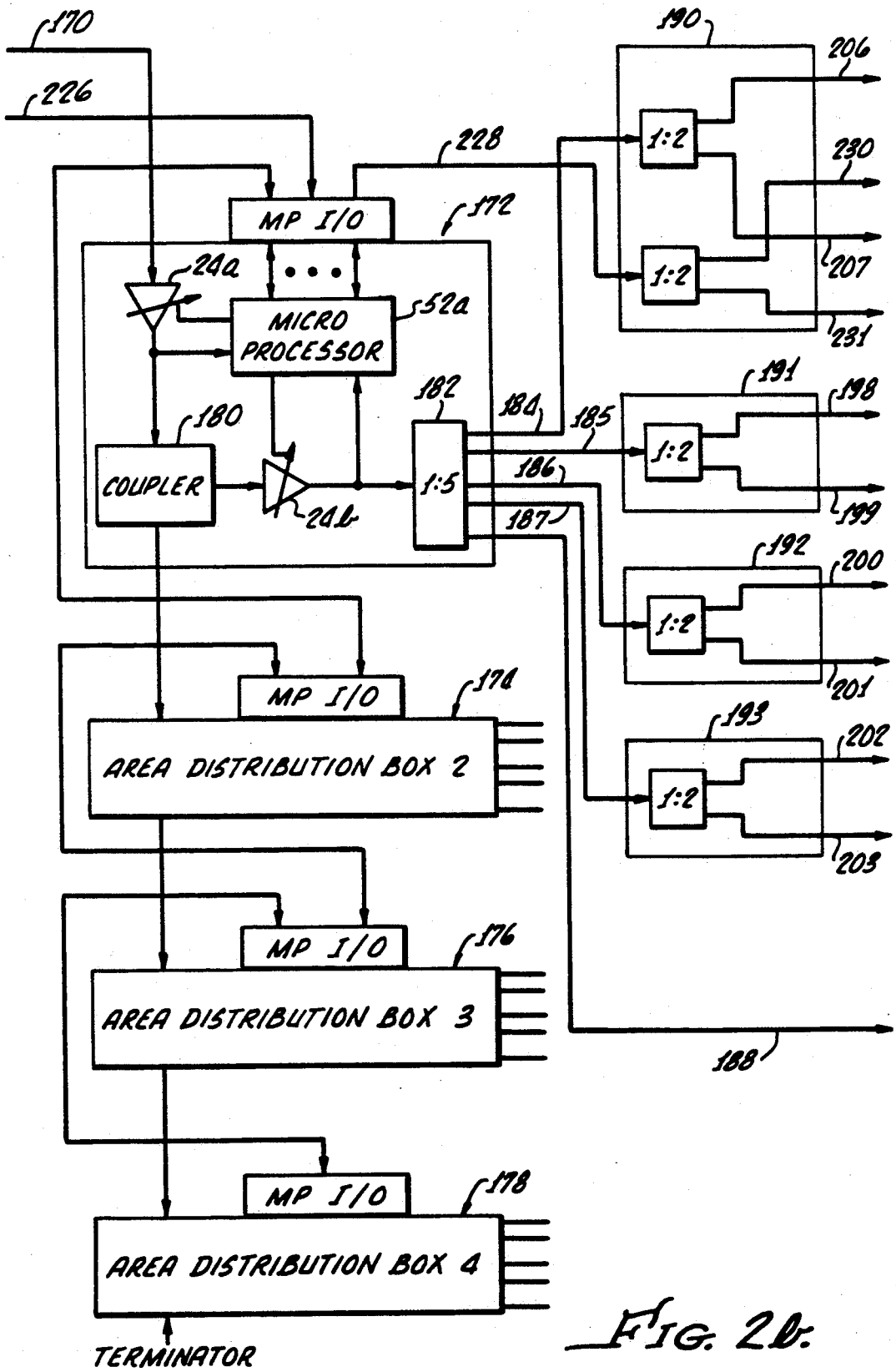
Figure 2C:
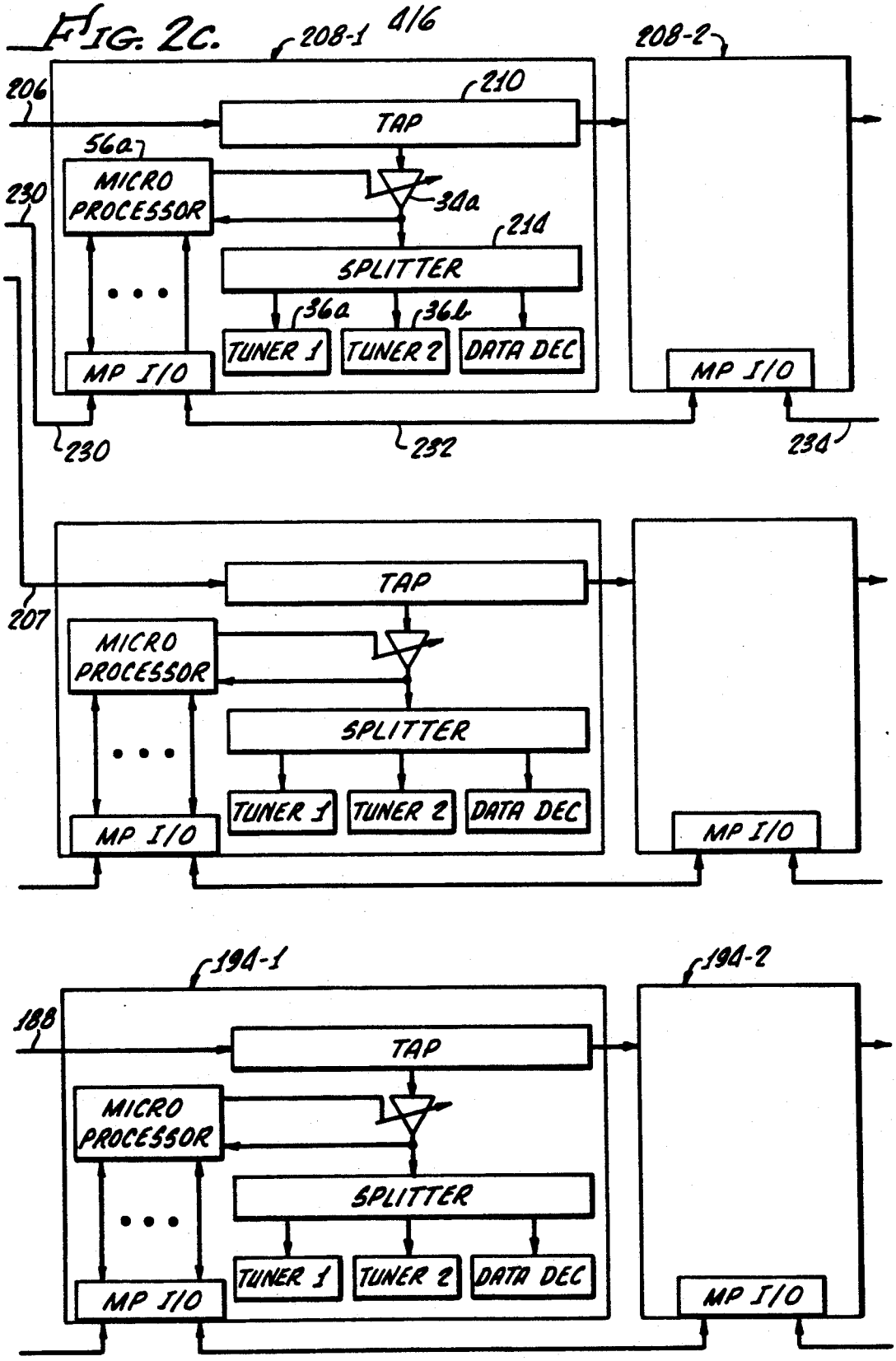

Area distribution box 172, via coaxial cables 184, 185, 186, 187 and 188, feeds stations of a group of similar stations designated as floor disconnect boxes (FDB's) 190, 191, 192, and 193, in addition to feeding directly to a line of stations denoted as video seat electronic boxes (VSEB's) 194-1 through 194-6, including 194-2 (FIG. 2c). Each of the video seat electronic box stations 194-1 through 194-6 feeds a pair of tuners, each of which is individual to a single seat.

Each of the floor distribution boxes, stations 191, 192 and 193 feeds via a pair of output lines 198, 199, 200, 201, 202 and 203, respectively, to two lines of 15 video seat electronic box stations each, each line feeding to individual tuners at the passenger seats.

Figure 2D:
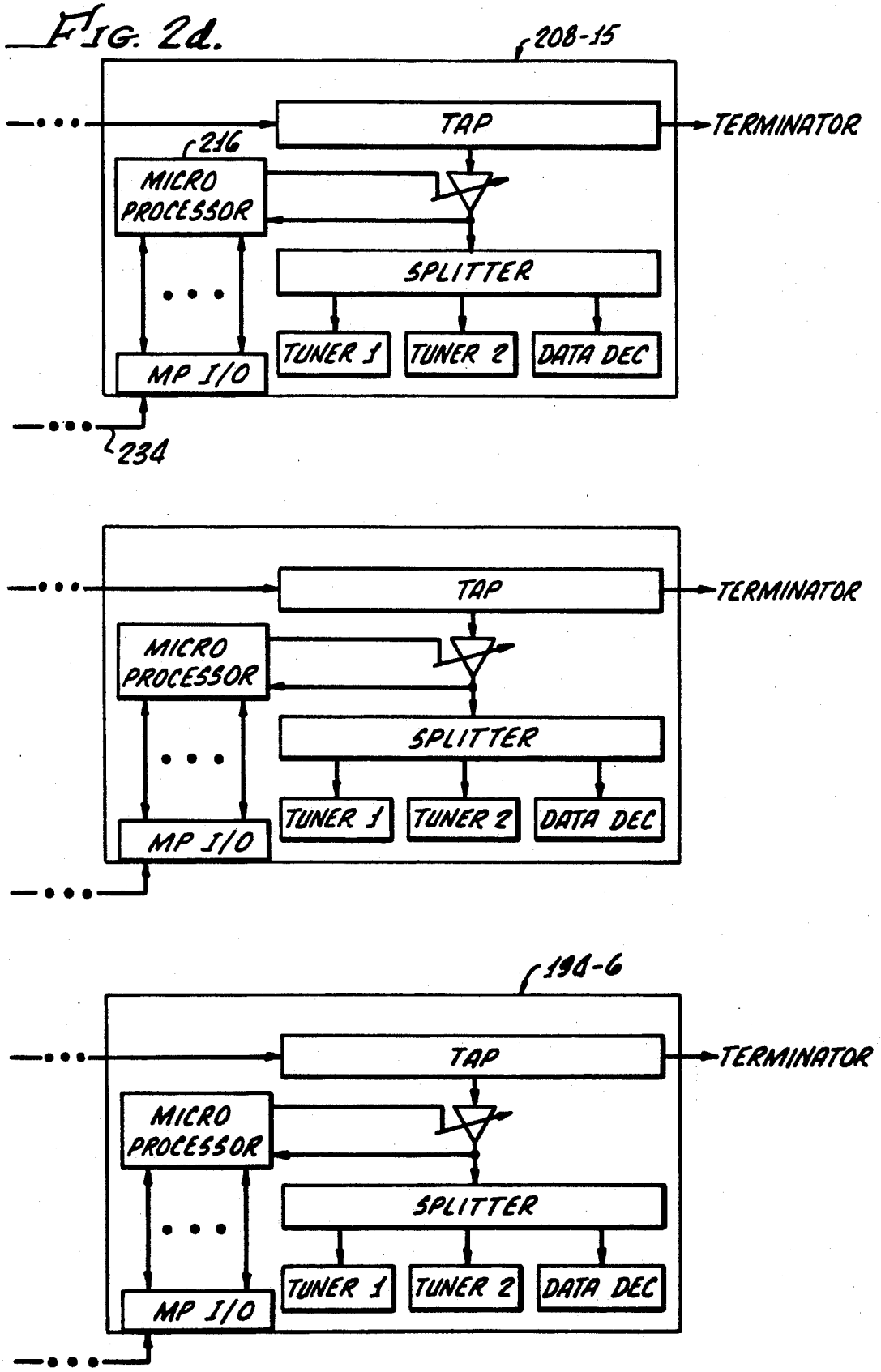

Similarly, floor distribution box 190 feeds, via a coaxial cable 206, a video seat electronic box station 208-1, which is the first in a line of 15 video seat electronic box stations of which that indicated at 208-2 and that indicated at 208-15 are shown in FIG. 2c and 2d. Each video seat electronic box includes a circuit 210 that transmits the video and audio modulated RF on down the line of video seat electronic box stations, and, in addition, taps off the signals for local use via a variable gain amplifier 34a (corresponding to amplifier 34 of FIG. 1). The output of amplifier 34a feeds to a splitter 214, which in turn feeds a tuner 36a and a second tuner 36b, each of which is individual to an individual passenger. Each of the video seat electronic boxes of each of the lines of video seat electronic boxes is identical to all of the others, excepting only that, in the exemplary embodiment disclosed herein, the last line of video seat electronic boxes is only six in number, whereas all of the others are 15 in number. However, it will be readily understood that any one or more of the lines of video seat electronic boxes may have more or fewer stations as determined by the desired aircraft configuration.

As an example of the physical arrangement of the system and lengths of cables employed, coaxial cable lengths in a typical system may be ten feet between stations 80 and 12a, fifty feet between stations 12a and 150, thirty-three feet between stations 150 and 172, thirty to forty feet between each of the successive area distribution box stations 172, 174, 176 and 178, thirty-three feet between the area distribution box station 172 and each of the floor disconnect stations 190,191, 192 and 193, and seven feet between the floor distribution box station 190 and the next VSEB. A cable length of seven feet connects each pair of adjacent ones of the VSEB's in a single line serviced by the one floor distribution box 190. Thus it can be seen that reconfiguration may cause significant changes in cable length, thereby causing changes in signal levels due to changes in the transmission loss through the cable.

Each video seat electronic box station includes a microprocessor, such as microprocessors 56a (corresponding to microprocessor 56 of the simplified arrangement of FIG. 1) and microprocessor 216 of video seat electronic box 208-15. The floor distribution box stations have no microprocessors nor amplification, but each area distribution disconnect box includes a microprocessor, such as microprocessor 52a of station 172, and equivalent microprocessors in each of stations 174, 176 and 178 (which are not illustrated in the drawings). Each of the passenger entertainment service controller stations 150 and 12a includes its own microprocessor, such as microprocessor 220 for station 150 and microprocessor 50a (corresponding to microprocessor 50 of FIG. 1) for station 12a.

The separate service line illustrated in FIGS. 2a, 2b, 2c and 2d is shown to include line 222 from station 80 to station 12a, line 224 from station 12a to station 150, line 226 from station 150 to the first area distribution box station 172, line 228 from station 172 to floor disconnect box 190, and connecting cables 230, 232 and 234 interconnecting the several video seat electronic box stations 208-1 through 208-15. Similar service cables interconnect each video seat electronics box with its adjacent VSEB and its associated floor distribution box for all stations served by each floor distribution box. Further, the independent service cable path has legs interconnecting each of the area distribution box stations 172, 174, 176 and 178, all to enable servicing and communication paths independent of the signal transmission path. The interconnections of the several service lines are accomplished through the microprocessor input/output logic that is provided at each station having a microprocessor, such as, for example, the input/output circuits 94, 60a and 240 of the stations 80, 12a and 150 respectively.

As previously described, the microprocessor at each station controls the gain of its associated amplifier and, together with the amplifier, initially acts as an automatic gain control circuit to maintain the RF level at the output of the controlled variable gain amplifier. If, however, the RF signal level varies by an amount that is too great to be controlled at any single station by the components of such station, this information, as previously mentioned, is transmitted back through the service line to the microprocessors of the several upstream stations, including the central microprocessor 50a of station 12a. If the problem can be corrected by the microprocessor of the next upstream station, then this will be done. As many upstream microprocessors are employed for the correction as necessary to correct the problem.

The several video seat electronic boxes are each tapped off the signal line, and thus their variable gain amplifiers are not in series with one another, so that the next upstream station of each VSEB in a single line of VSEB's is its associated area distribution box. For example, if there is an RF level at the monitoring point of amplifier 34a of VSEB 208-1 which cannot be corrected by the microprocessor 56a at this station, the system is arranged so that the microprocessor 52a at the next upstream station, which is area distribution box 172, will attempt to control the gain of its amplifier so as to obtain a voltage level within the desired range at VSEB 208-1. Again, if this is not sufficient, the next upstream station, station 150, has its microprocessor 220 arranged to vary the gain of its amplifier 164 so as to appropriately control the downstream signal level at the problem amplifier, which in this example is amplifier 34a at station 208-1.

It may be noted, however, that if the problem is a low RF level, so that boosted gain is necessary for the upstream amplifier at station 172, namely amplifier 24b, the increased gain of such upstream amplifiers will result not only in a corrected increase of gain for amplifier 34a, but will also result in an increased (undesired) signal level at each of the other VSEB stations that receive signals from the floor disconnect boxes 190, 191, 192, 193 or on line 188 from ADB 172. Accordingly, when an upstream amplifier, such as amplifier 24b for example, has its gain increased in order to correct for a lowered RF level at one of the video seat electronic boxes, an appropriate compensating signal is also sent to all of the other VSEB's that receive the boosted signal so that this appropriate compensating signal will, via the individual microprocessor at the specific VSEB, decrease the gain of the variable gain amplifier at such station.

A similar condition will exist if amplifier 24a of station 172 is increased in gain (this amplifier will affect not only each of the VSEB stations that receive signals from ADB 172, but also all those VSEB stations that receive signals from ADB 174, 176 and 178).

Figure 3:
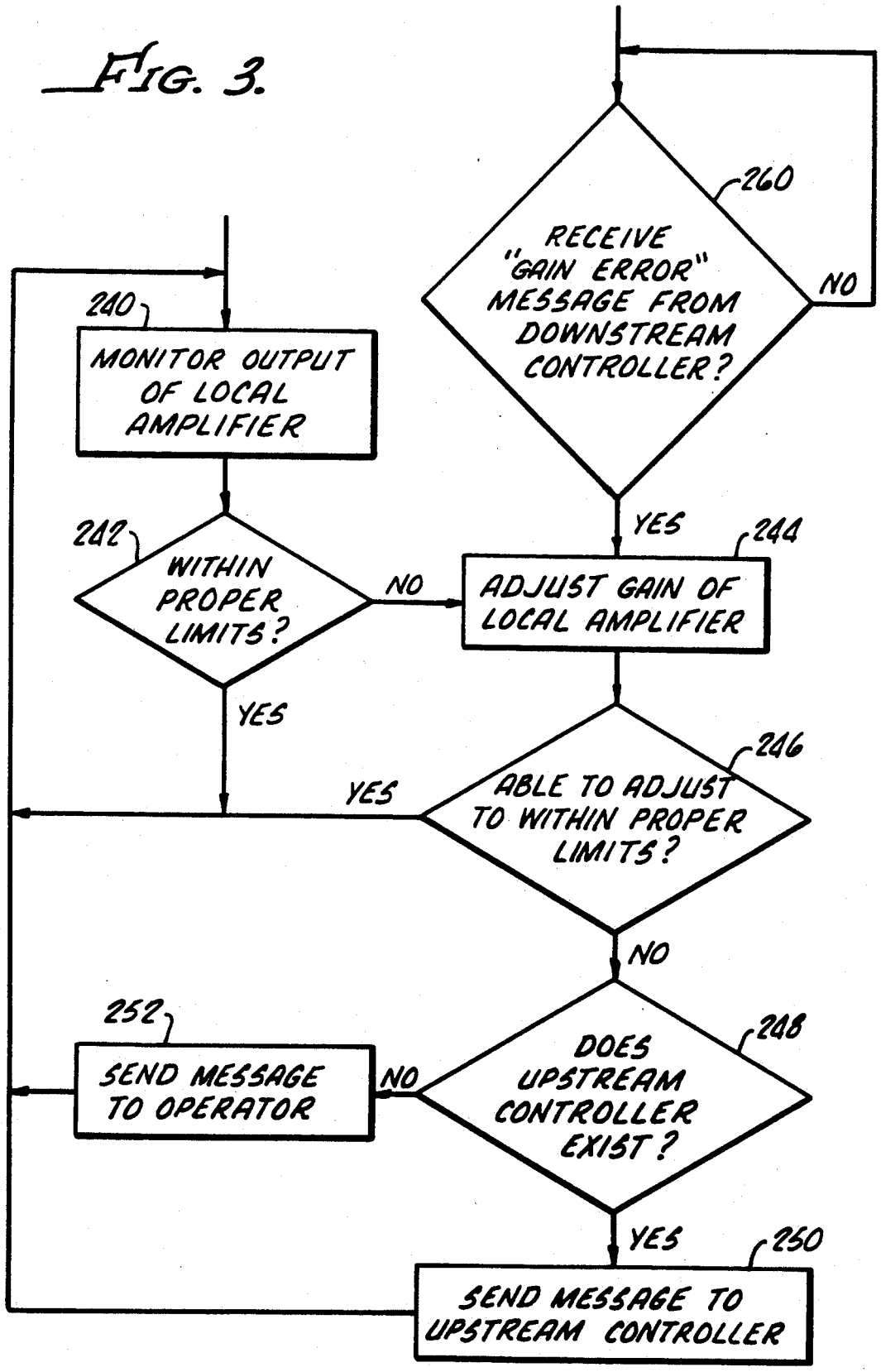
FIG. 3 is a flow chart for a program for a master processor.

Illustrated in FIG. 3 is a flow chart of a program for decision making logic to be carried out at the master microprocessor 50a. This program is substantially the same as the programs employed in microprocessors at other stations, except that each must be specifically modified to account for its particular position in the audio video signal path from the signal sources to the tuners.

Outputs of the local amplifiers are monitored, as indicated in block 240, and compared with the preset limits to determine whether the outputs are within the assigned limits, as indicated at block 242. If the signals are within limits, the program returns to the input at block 240. If the signals are not within proper limits, the gain of the local amplifier is adjusted, as indicated at block 244. Upon adjustment of the local amplifier gain a decision is made as to whether the local amplifier had sufficient range to adjust the signal to within the desired limits, as indicated at block 246. If the adjustment range of the amplifier is adequate, the system returns to the input of block 240. If the adjustment range is not adequate, a decision is made as to whether or not an controller exists that is upstream with respect to the local amplifier, as indicated at block 248. If such an upstream controller exists, then, as indicated at block 250, a message is sent to such upstream controller to enable adjustment of the gain of the variable gain amplifier of the station of such upstream controller. If there is no upstream controller an appropriate message is sent to the operator, as indicated at block 252, to indicate that suitable correction cannot be made.

In addition, the system may receive a signal from a downstream controller, and, on the basis of this signal, which indicates that there is a downstream gain error or an improper RF level at a downstream amplifier, a determination is made as to whether or not such a signal has been received, as indicated in decision block 260. If there is no such downstream signal received the system returns to monitor the downstream cable connection. If there is such a gain error signal received from the downstream controller, the system proceeds to adjust the gain of the local amplifier, as indicated in block 244.

What is claimed is:

1. An adjustable level signal transmission system comprising:

a chain of stations through which a signal is transmitted in sequence from one station to the next, at least a group of said stations each including a variable gain amplifier connected to receive said signal transmitted from an upstream station and to transmit the received signal to the next downstream station in the chain, at least some of said stations including means for tapping the signal for use at an individual station, means for monitoring output signal levels of the amplifiers at at least some of the stations of said group, and means responsive to the monitored signal levels for commanding variation of the gain of a first relatively upstream one of said amplifiers that is upstream from a second relatively downstream one of said amplifiers in response to occurrence of a monitored signal level at said downstream amplifier that is outside of a predetermined range of signal levels, at least a third relatively downstream amplifier having its gain varied by said means for commanding, and including means for compensating said third downstream amplifier for a commanded gain variation of said first upstream amplifier.

2. A passenger aircraft video distribution system comprising:

a passenger entertainment service controller station (PESC) having audio and video inputs and including means for processing said inputs to provide a transmitted output comprising a plurality of RF carriers having audio and video signals modulated thereon, said PESC station including a PESC variable gain amplifier connected to receive said inputs, an area distribution box station (ADB) having a first ADB variable gain amplifier connected to receive the output of said PESC station, said area distribution box station comprising:

an ADB coupler responsive to said first ADB variable gain amplifier and providing a first output, a second ADB variable gain amplifier connected to receive a signal from said coupler and to provide a transmitted ADB output signal comprising said carriers having said audio and video signals modulated thereon on, and a line of interconnected video seat electronic box stations (VSEB), each having at least one tuner for manual operation by a passenger at the respective VSEB station, each of a group of said VSEB stations including a VSEB coupler responsive to said ADB output signal and providing a modulated RF carrier output transmitted to the next VSEB station in said line of VSEB stations, each said VSEB station of said group including a VSEB variable gain amplifier connected between said VSEB coupler and the tuner of the respective VSEB station, each of said variable gain amplifiers including a monitoring terminal for providing a monitor signal indicative of the RF level of signal at the output of the respective variable gain amplifier, and means responsive to the monitoring terminal of one of said ADB and VSEB variable gain amplifiers for controlling the gain of the variable gain amplifier of at least one station upstream from said one of said ADB and VSEB amplifiers to thereby adjust the RF signal level at the output of said one VSEB or ADB amplifier.

3. The system of claim 2 wherein each of said PESC, ADB and VSEB stations includes microprocessor means for controlling the gain of the amplifier at the respective station.

4. The system of claim 2 wherein said means responsive to the monitoring terminal includes a service line separate from the independent of transmission of the RF carriers between said PESC station and said ADB station and said VSEB stations.

5. The system of claim 4 including a PESC microprocessor at said PESC station, an ADB microprocessor at said ADB station, and a VSEB microprocessor at each of said VSEB stations, each said microprocessor including microprocessor means for controlling the gain of the amplifier at the associated station, at least one of said microprocessors including means for controlling the gain of amplifiers at other stations.

6. The system of claim 5 wherein said means responsive to the monitoring terminal for controlling the gain comprises said PESC microprocessor, said PESC microprocessor including means responsive to a signal at said monitoring terminal of one of the amplifiers at one of said ADB and VSEB stations for adjusting the gain of the amplifier at said PESC station to cause the level of the RF output of the amplifier at said one VSEB to fall within a predetermined range of levels.

7. The system of claim 5 wherein said means responsive to the monitoring terminal for controlling the gain comprises said ADB microprocessor, said ADB microprocessor including means responsive to a signal at said monitoring terminal of the amplifier of one of said ADB and VSEB stations for adjusting the gain of the amplifier at at least one of said ADB and PESC stations to cause the level of the RF output of the amplifier at said one VSEB station to fall within a predetermined range of levels.

8. The system of claim 6 wherein said PESC microprocessor includes means for adjusting the gain of the amplifier at at least one of the VSEB stations other than said one VSEB station to compensate for adjustment of the gain of the amplifier at said PESC that is effected in response to the monitoring signal at the output of the amplifier at said one VSEB station.

9. In a signal transmission system having first, second and third stations connected successively in a chain of stations by a signal transmission line, each station having a variable gain amplifier for controlling level of signals received thereby and for transmitting and receiving signals, a method of controlling level of signals received at said stations comprising the steps of:

monitoring the received signal level at the output of said amplifiers, employing the signal level monitored at the output of the amplifier of said second station to vary the gain of the amplifier at said first station, wherein said first station is located upstream relative to said second station, thereby nominally varying the level of signal transmitted to said third station, and adjusting the gain of the amplifier at said third station to compensate for the variation in gain of the amplifier at said first station, wherein said third station is located downstream relative to said second station.

* * * * *